US006388749B1

(12) United States Patent
Yamashita et al.

(10) Patent No.: US 6,388,749 B1
(45) Date of Patent: May 14, 2002

(54) MONITORING APPARATUS

(75) Inventors: Hiroshi Yamashita; Hiroshi Iwata, both of Hiroshima; Setsuo Suzuki, Mihara; Toshihiro Tokudome; Masayuki Ogawa, both of Kasugai; Isao Kodaka, Tokyo; Masatoshi Kaku; Hisao Usogoe, both of Kasugai, all of (JP)

(73) Assignee: Mitsubishi Heavy Industries, Ltd., Tokyo (JP)

( * ) Notice: Subject to any disclaimer, the term of this patent is extended or adjusted under 35 U.S.C. 154(b) by 0 days.

(21) Appl. No.: 09/442,233

(22) Filed: Nov. 17, 1999

(30) Foreign Application Priority Data

Nov. 17, 1998 (JP) ..... 10-325781

(51) Int. Cl.[7] ..... G01N 21/84
(52) U.S. Cl. ..... 356/430; 356/429
(58) Field of Search ..... 356/429, 430, 356/431, 237.1, 238.2; 256/571

(56) References Cited

U.S. PATENT DOCUMENTS

| | | | | |
|---|---|---|---|---|
| 4,203,672 A | * | 5/1980 | Smith, Jr. | 356/431 |
| 4,224,513 A | | 9/1980 | Casey et al. | 250/216 |
| 4,582,095 A | | 4/1986 | Kronholm | 139/1 R |
| 4,791,304 A | | 12/1988 | Iida | 250/563 |
| 4,955,720 A | * | 9/1990 | Blecha et al. | 356/429 |
| 5,354,992 A | * | 10/1994 | Thompson et al. | 250/548 |
| 5,778,724 A | * | 7/1998 | Clapp et al. | 73/159 |
| 5,899,959 A | * | 5/1999 | Shields et al. | 702/35 |

FOREIGN PATENT DOCUMENTS

| | | |
|---|---|---|
| DE | 1 098 739 | 2/1961 |
| DE | 27 01 992 | 7/1978 |
| DE | 195 10 009 | 9/1996 |
| EP | 0 329 889 | 8/1989 |
| JP | 2-090047 | 3/1990 |
| JP | 4-115148 | 4/1992 |
| JP | 5-117990 | 5/1993 |
| JP | 6-294092 | 10/1994 |

* cited by examiner

*Primary Examiner*—Frank G. Font
*Assistant Examiner*—Michael P. Stafira
(74) *Attorney, Agent, or Firm*—Alston & Bird LLP

(57) ABSTRACT

There is provided a monitoring apparatus for preventing paper breakage. For this monitoring apparatus, a light source 9 is disposed on the upper side of a wet paper 1, and a light emitting face thereof faces downward. An operation-side camera 5a and a drive-side camera 5b are disposed on the side opposite to the light source 9 with respect to the wet paper 1, and a lens face thereof faces upward. Light 9a of the light source 9 passes through the wet paper 1 after being reflected from a mirror 11, and is caught by the cameras 5a and 5b. Thus, the cameras 5a and 5b photograph a silhouette (image) of the light 9a of the light source 9, which has passed through the wet paper 1. This image is sent to an image processing unit 6, where the image is processed. The coordinates of a boundary line such that the wet paper 1 separates from a center roll 2 is detected from the images photographed from two directions. This coordinate value is sent to a computer 8. The computer 8 converts the value into a movement amount in each sampling cycle to determine the change amount and frequency of a separation point 3 and the whole shape of separation lines 3a and 3b. Thereby, a machine trouble resulting in paper breakage can be predicted.

15 Claims, 7 Drawing Sheets

MONITORING APPARATUS

FIELD OF THE INVENTION AND RELATED ART STATEMENT

The present invention relates to a monitoring apparatus for monitoring a band-shaped object running continuously and, more particularly, to a monitoring apparatus for monitoring the flow of paper in, for example, a paper machine.

For a conventional paper machine, an operator performs monitoring while roving periodically during the operation to check the conditions of operation, by which the stable operation of the machine is achieved. To detect the occurrence of paper cut, a paper cut detecting sensor, which consists, for example, of an infrared irradiator disposed on the outer side of a running paper and a detector disposed on the inner side of the running paper, is installed on the machine. When the paper is cut, the detector detects the infrared rays, by which paper cut is recognized.

With such a paper cut detecting sensor, although paper cuts can be found, the cause for the paper cut cannot be known. For this reason, in recent years, paper conditions are monitored by installing a camera and a light source, and also the conditions are recorded on a video cassette recorder or a digital memory and the state of paper breakage is replayed. Thus, the operator can understand the cause for paper cut.

However, with this method, the recorded scene showing the state of paper cut is only replayed, but paper breakage (paper cut) cannot be prevented.

OBJECT AND SUMMARY OF THE INVENTION

The present invention has been made in view of the above situation, and accordingly an object thereof is to provide a monitoring apparatus that prevents abnormal running of paper by detecting the abnormal running, and also prevents paper breakage. Further, another object of the present invention is to prevent abnormal running of a band-shaped object running continuously.

To achieve the above objects, the present invention provides a monitoring apparatus in which light from a light source is caused to penetrate a band-shaped object running continuously, the object is photographed by using the transmitted light, and the image is processed, by which a change amount relating to the running path of the object is quantitatively monitored.

The present invention can be applied to a case where a place where paper is easily broken is monitored on, for example, a paper machine. That is to say, light from a light source is caused to penetrate a running paper in the paper machine, the running paper is photographed by using the transmitted light, and the image is processed, by which the change amount of separation point where the running paper separates from a roll is monitored quantitatively to diagnose a trouble of the paper machine.

The monitoring apparatus in accordance with the present invention comprises light emitting means for causing light to fall on a paper run by rolls in the paper machine, photographing means for photographing the light penetrating the paper from the light emitting means, image processing means for processing the image of the photographing means, and diagnosis means for diagnosing a trouble of the paper machine by quantitatively monitoring the change amount of separation point from the roll based on the processing results of the image processing means.

In particular, the present invention can be applied even to a case where the photographing environment of the portion to be monitored is deteriorated, for example, by the occurrence of mist. In this case, as the light source of the light emitting means, a metal halide lamp is preferably used.

It is preferable that the trouble diagnosis conditions be set in advance based on the change amount of the object at the normal time. When the trouble diagnosis conditions are influenced by various environmental conditions, it is preferable that the trouble diagnosis conditions be changed with the change in the environmental condition. For example, the conditions for diagnosing a trouble in the diagnosis means should be made capable of being changed according to the basis weight and draw amount of paper.

When machine is judged to have a trouble, a configuration for automatic control for making the machine operation normal is most preferable. Specifically, when a trouble is diagnosed, paper cut is prevented by further providing control means for controlling the draw amount according to the result of diagnosis.

The photographing with the photographing means should preferably be performed by a plurality of cameras by dividing the photographing region (portion to be monitored). Specifically, each region provided by dividing the portion to be monitored should be photographed by a different camera. Also, the processing in the image processing means should be performed with a plurality of images obtained by photographing the different regions.

When the object is a paper (running wet paper) of a paper machine, and the state of the paper is monitored, the most preferable configuration is such that (1) the photographing direction of camera and the position of light source are in an opposite positional relationship with respect to the paper,
(2) in the image processing, the change amount of separation point, which is a point where the paper separates from the roll, is monitored quantitatively to diagnose a trouble of the machine,
(3) the trouble diagnosis conditions are changed according to the basis weight and draw amount of paper, and
(4) the draw amount is automatically controlled according to the result of trouble diagnosis to prevent paper cut.

The basis weight in this specification is a weight per one sheet of paper of 1 $m^2$. The draw amount is the degree of tension of web between the parts of the paper machine, and is determined by the difference in speed between the driving rolls of the sections of the paper machine.

As is apparent from the above description, the present invention achieves the effects described below.

In the present invention, light from a light source is caused to penetrate a band-shaped object running continuously, the object is photographed by using the transmitted light, and the image is processed, by which a change amount relating to the running path of the object is quantitatively monitored. Therefore, the change in running of the object can always be grasped, so that accurate monitoring can be performed.

Also, the monitoring apparatus in accordance with the present invention comprises light emitting means for causing light to fall on a paper run by rolls in a paper machine, photographing means for photographing the light penetrating the paper from the light emitting means, image processing means for processing the image of the photographing means, and diagnosis means for diagnosing a trouble of the paper machine by quantitatively monitoring the change amount of separation point from the roll based on the processing results of the image processing means. Therefore, the change in running of the object can always be grasped, so that accurate monitoring can be performed.

If a metal halide lamp is used as the light source of the light emitting means, the separation from the peripheral equipment can be made well in the image processing, so that accurate monitoring can be performed even when the photographing environment is adverse.

If the trouble diagnosis conditions are made capable of being changed according to the basis weight and draw amount of paper in the diagnosis means, the diagnosis accuracy is improved, and most preferable monitoring can be performed.

If controlling means is further provided to control the draw amount according to the diagnosis result when a trouble is diagnosed, paper cut can be prevented by correcting the shape of profile, and a press part etc. can be controlled.

If the configuration is such that the photographing with the photographing means is performed by different cameras for regions provided by dividing the portion to be monitored, and the processing in the image processing means is performed with a plurality of images obtained by photographing the different regions, the effect of the photographing environment can further be reduced, and the change in the object or the running paper can be grasped exactly, so that more accurate monitoring can be performed.

DETAILED DESCRIPTION OF PREFERRED EMBODIMENTS

An embodiment of a monitoring apparatus in accordance with the present invention will now be described with reference to the accompanying drawings.

The following is a description of a case where a monitoring apparatus in accordance with one embodiment of the present invention is applied to a paper machine. In this case, the monitoring apparatus monitors the operation conditions of the paper machine.

A paper machine broadly includes a stock inlet, a wire part, a press part, and a dry part. Additionally, it is usually provided with a calender part and a reel part. As one example, a papermaking process in the case of a Fourdrinier paper machine will be explained. Carefully selected pulp liquid is sprayed from the stock inlet onto an endless wire. The pulp liquid is dehydrated in a suction box, and passes through a slice and gets a fixed thickness. At the press part, a felt is turned together with press rolls to squeeze water and at the same time to smoothen the surface of paper (formation of web). Subsequently, the paper is heated to dry at the dry part. At the calender part, the paper surface is smoothened and calendered. Finally, the web is wound by the reel part.

Figure 1:
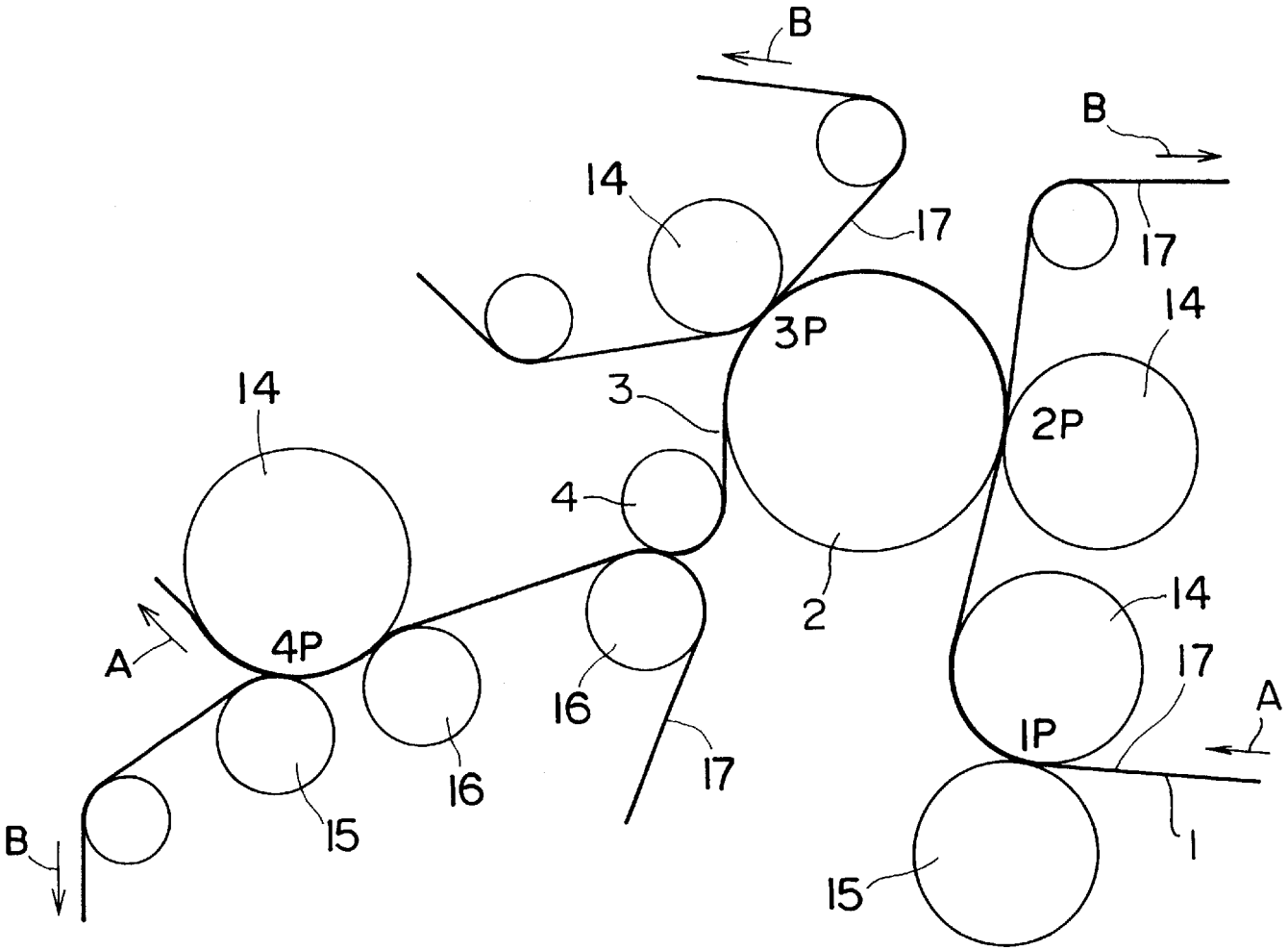
FIG. 1 is a side view schematically showing a press part of a paper machine to which a monitoring apparatus in accordance with one embodiment of the present invention is applied.

Next, the press part at which the monitoring apparatus is disposed will be explained. The press part of this embodiment shown in FIG. 1 has four-stage presses of a first press (1P) to a fourth press (4P), and is provided with a center roll 2, press top rolls 14, press bottom rolls 15, suction rolls 16, and a paper roll 4. A wet paper 1 is conveyed in the direction of arrow A by these rolls 2, 14 to 16, and 4, and a felt 17. This wet paper 1 is a web that has been formed at the wire part and transferred to the press part. To clean the center roll 2, a shower (not shown) is provided in the vicinity thereof.

Figure 2:
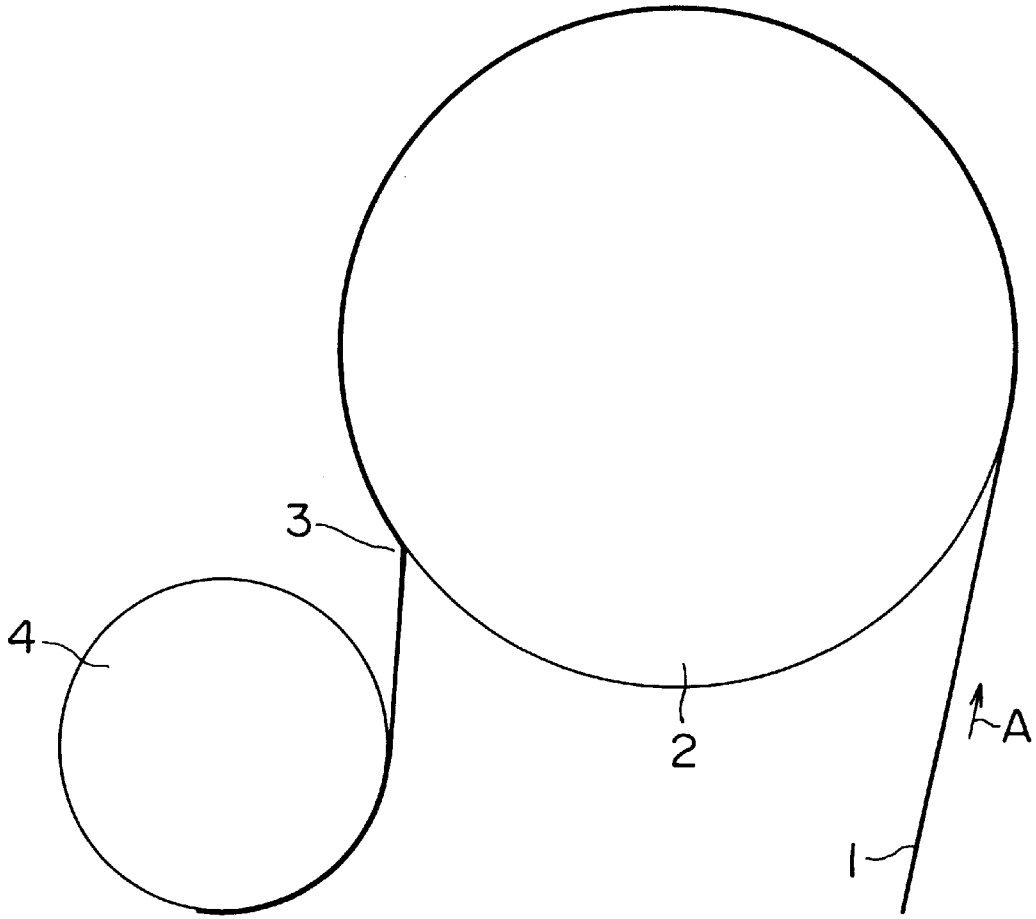
FIG. 2 is an enlarged view of a center roll outlet at the press part shown in FIG. 1.

At the center roll section of the press part, the wet paper 1 is separated from the felt 17. Further, as shown in FIG. 2, the wet paper 1 is separated from the surface of the center roll 2 at a separation point 3 (separation), and is transferred to the next process via the paper roll 4. At this separation point 3, the wet paper 1 is not supported by the felt 17 or the like (open draw). Therefore, paper breakage (paper cut) occurs most frequently at this point. Thus, monitoring of the separation point 3 is important for stable operation of machine without paper breakage. The monitoring apparatus in accordance with one embodiment of the present. invention monitors the change around the separation point 3.

Figure 3:
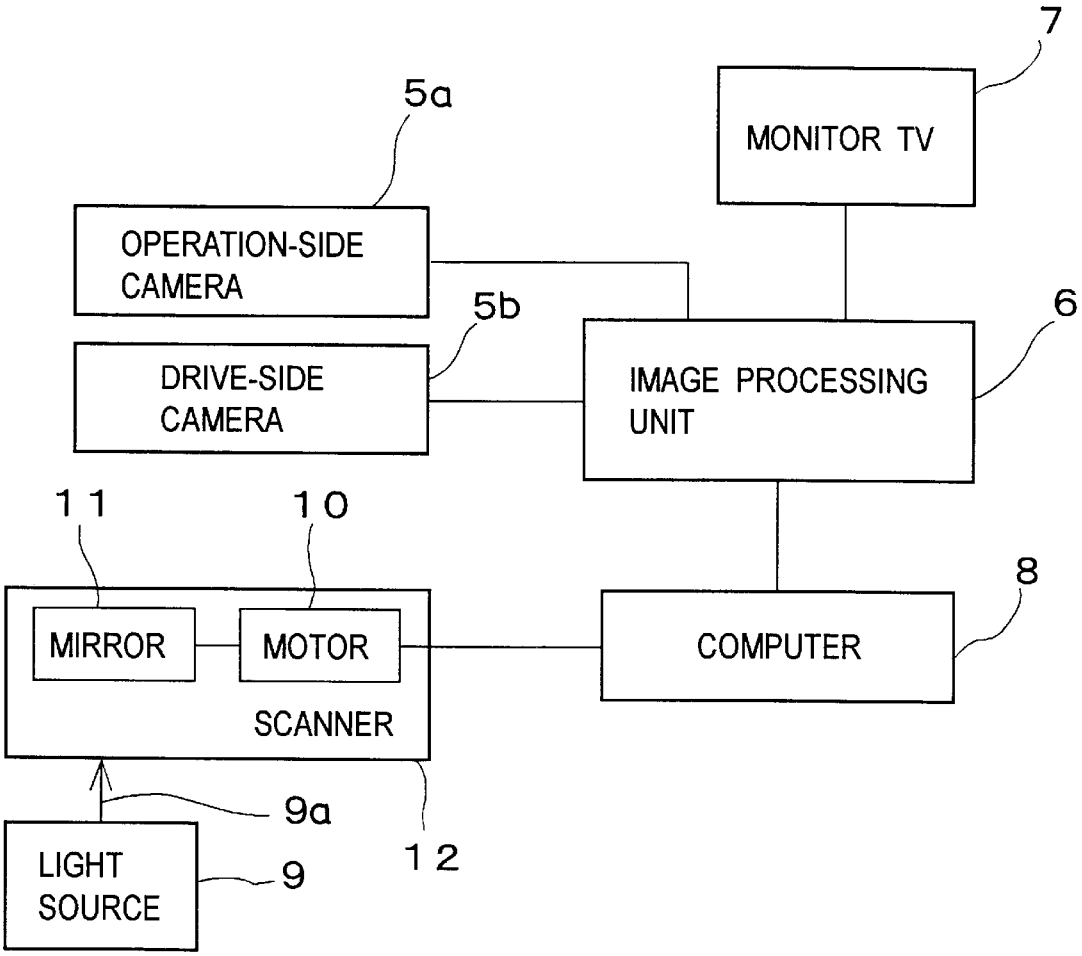
FIG. 3 is a system block diagram for a monitoring apparatus in accordance with one embodiment of the present invention.
Figure 6:
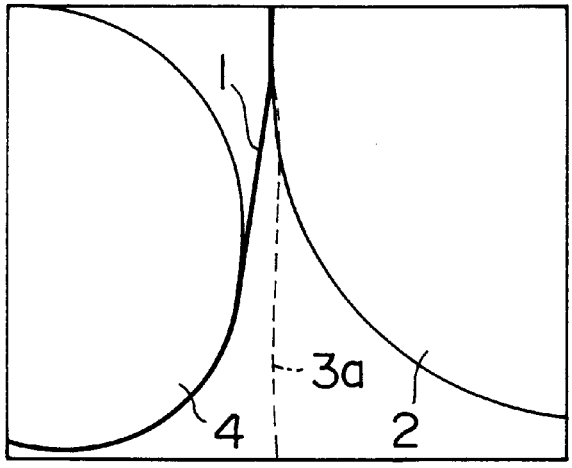
FIG. 6(*a*) is a view showing a typical image photographed by an operation-side camera 5*a,* and FIG. 6(*b*) is a view showing an image photographed by a drive-side camera 5*b* in this case.
Figure 6:
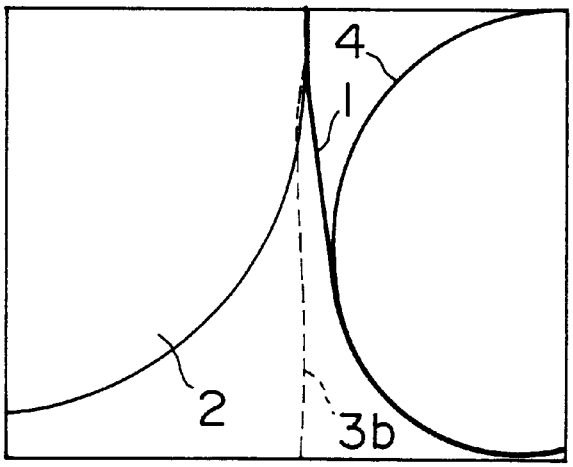

Next, elements of the monitoring apparatus will be explained with reference to FIG. 3. The monitoring apparatus comprises an operation-side camera 5*a,* a drive-side camera 5*b,* an image processing unit 6, a monitor TV 7, a computer 8, a light source 9, a motor 10, and a mirror 11. The motor 10 and the mirror 11 constitutes a scanner 12 for scanning with light 9*a* from the light source 9. The monitor TV 7 displays the cross sections of the center roll 2 and the paper roll 4 and the shape of the running wet paper 1 and the separation line 3*a,* 3*b* thereof as shown in FIGS. 6(*a*) and 6(*b*), for example.

The operation-side camera 5*a* and the drive-side camera 5*b* are connected to the image processing unit 6. This image processing unit 6 is connected to the monitor TV 7 and the computer 8. This computer 8 is connected to the scanner 12. The mirror 11 of this scanner 12 is mechanically connected to the motor 10 so that the direction of the surface thereof is changed by the motor 10 (see arrow B in FIG. 4). As this mirror 11, for example, a galvanometer-mirror or a polygon-mirror can be used. This galvanometer-mirror or polygon-mirror is a rotating member having a series of planar reflecting surface, and is used in a scanning system for reflecting light from a light source from a scanned object.

As the light source 9, a metal halide lamp is used in this embodiment. This metal halide lamp is a high intensity discharge lamp in which light is emitted by electric discharge in a mixture of metallic vapor and dissociation product of halide, serving as a powerful light source with a flat wavelength distribution. By using this metal halide lamp, the paper image can be separated well from images of the peripheral equipment in image processing by making the best use of a color feature of the wet paper 1, namely that the wet paper is white.

Next, a positional relationship between the operation-side camera 5*a,* the drive-side camera 5*b,* the center roll 2, and the wet paper 1 will be explained with reference to FIGS. 4 and 5.

Figure 5:
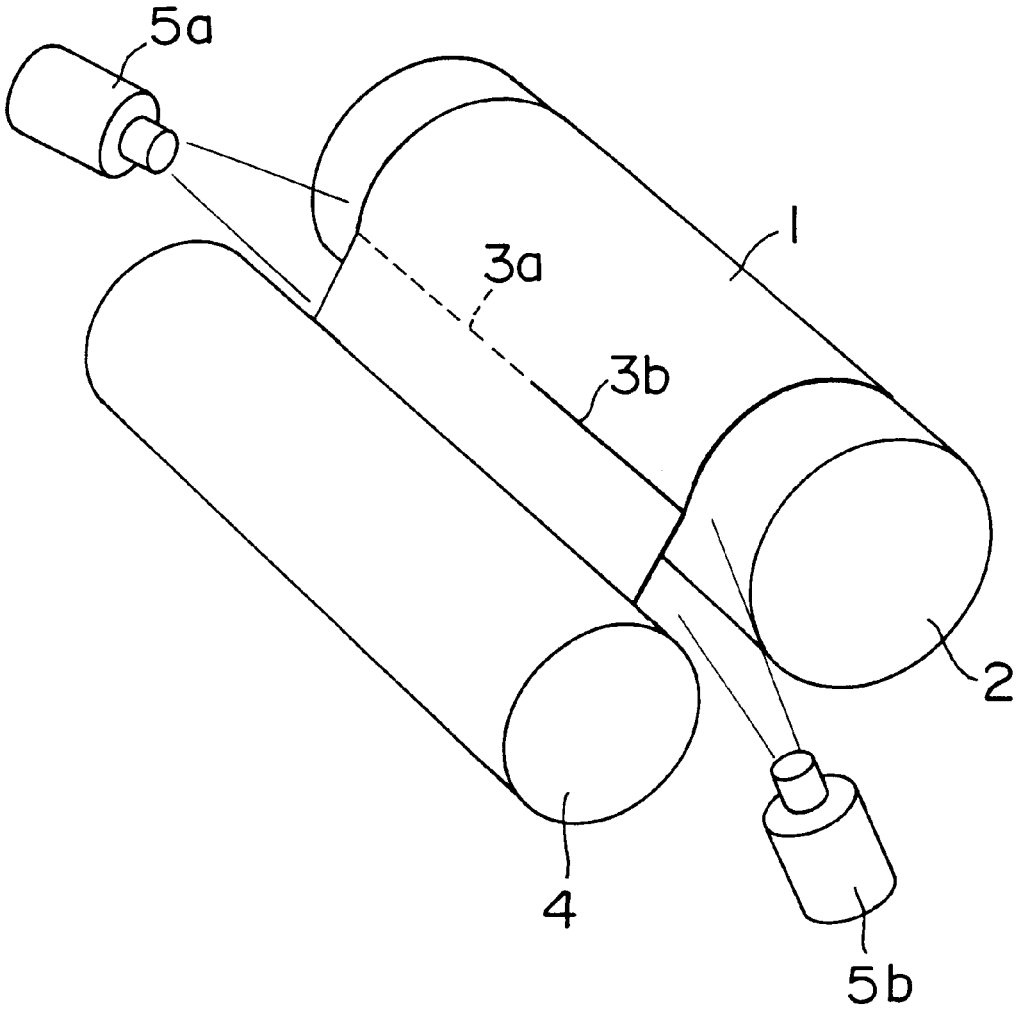
FIG. 5 is a perspective view schematically showing a positional relationship between an operation-side camera, a drive-side camera, a center roll, and a wet paper.

As shown in FIG. 5, the operation-side camera 5*a* and the drive-side camera 5*b* are arranged in parallel. The operation-side camera 5*a* is disposed on the operation side of the center roll 2, and the drive-side camera 5*b* is disposed on the drive side of the center roll 2. The operation-side camera 5*a* and the drive-side camera 5*b* photograph a change in separation point. Specifically, a separation line 3*a* (indicated by the broken line in FIG. 5) on the operation side from the center in the axial direction of the center roll 2 is photographed by the operation-side camera 5*a,* and a separation line 3*b* (indicated by the solid line in FIG. 5) at the remaining half portion is photographed by the drive-side camera 5*b.* In FIG. 5, the separation line 3*a* is indicated by the broken line. However, this broken line does not mean a hidden line, and is used to distinguish it from the separation line 3*b* in this figure.

The separation point 3 in this embodiment is defined as a point where the paper edge of the wet paper 1 separates from the center roll 2, and the separation line 3*a,* 3*b* in this embodiment is defined as a line connecting positions where the wet paper 1 separates from the center roll 2 at an arbitrary position along the axial direction of the center roll 2 at a certain point of time.

Figure 4:
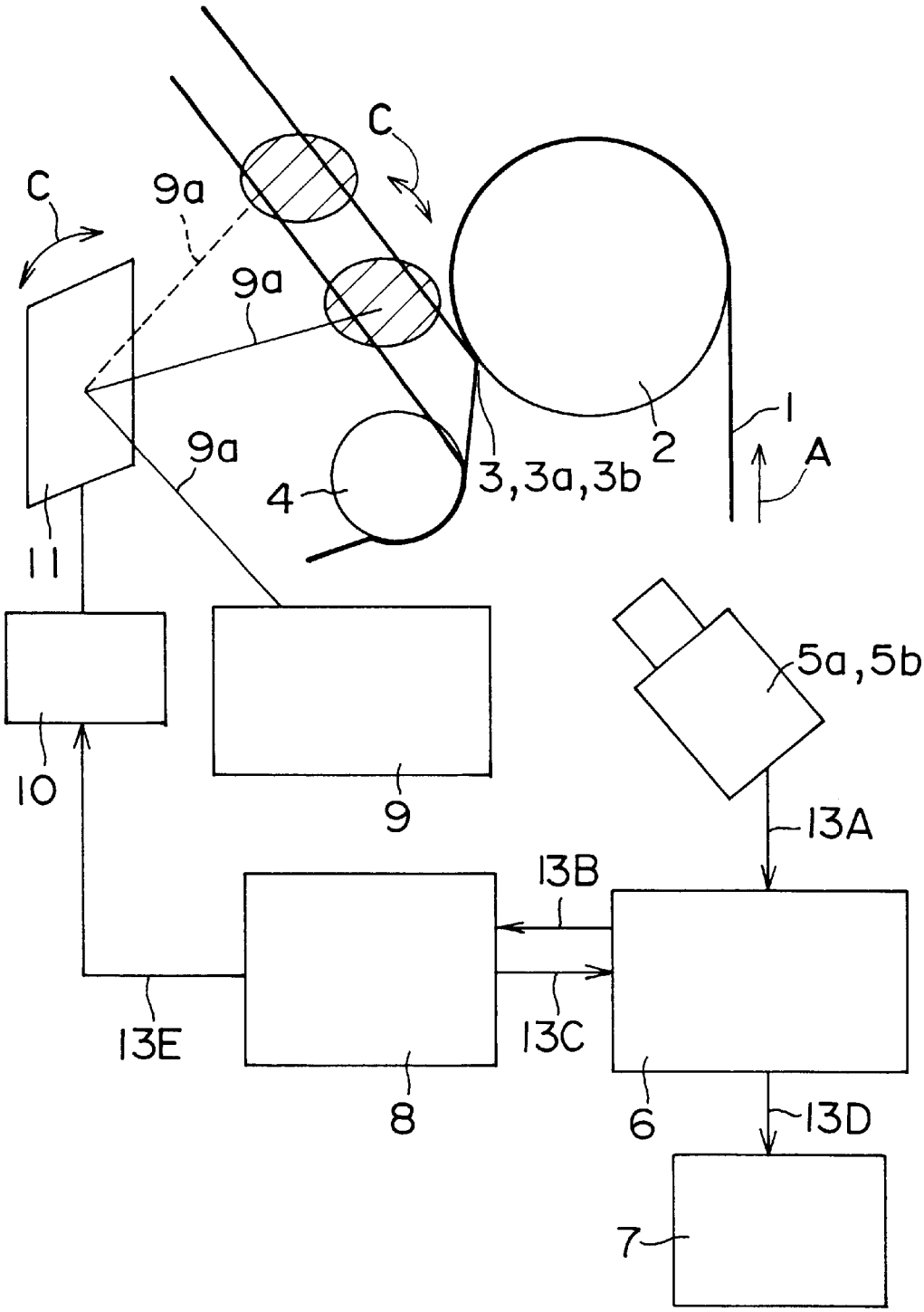
FIG. 4 is a configuration view of hardware shown in FIG. 3.

As shown in FIG. 4, the light source 9 is disposed on the side opposite to the operation-side camera 5*a* and the drive-side camera 5*b* with respect to the wet-paper 1. The operation-side camera 5*a* and the drive-side camera 5*b* are arranged on the lower side of the center roll 2, and the lens faces thereof face upward obliquely. The light 9*a* of the light source 9 passes through the wet paper 1 after being reflected from the mirror 11, and is caught by the operation-side camera 5*a* and the drive-side camera 5*b*. In other words, the operation-side camera 5*a* and the drive-side camera 5*b* photograph a silhouette (image) of the light 9*a* of the light source 9, which has passed through the wet paper 1.

This configuration can provide a clearer image. The reason for this is as follows: At the press part, a mist is easily produced by the aforesaid shower. Although light is generally irradiated from the same place as the camera, in such a place having an influence of mist, the separation point 3 and the separation lines 3*a* and 3*b* cannot be observed by the installation of ordinary cameras only, conjointly with a reason of less space. Also, at such a place, an image obtained by causing the light 9*a* to pass through the wet paper 1 is clearer than an image obtained by reflecting the light 9*a* from the wet paper 1.

Also, the photographing by using two cameras can increase the accuracy of change amount. The reason for this is as follows: If photographing is performed from only one direction, for example, on the operation side, the image cannot be photographed enlargedly, so that a high detection accuracy of separation line cannot be obtained over the whole width. Specifically, because the photographing region differs between the nearby part and the distant part, although the accuracy is high at the nearby part, the accuracy at the distant part is poor. When photographing is performed from both of the operation side and the drive side to obtain images up to a position near the center of the center roll 2, the separation line can be photographed enlargedly, and a detection accuracy that is double the accuracy provided by the photographing on one side only can be obtained. Further, because the influence of mist can be reduced, the detection accuracy can be increased further, so that a clear image can be obtained.

Additionally, if the number of cameras for photographing from one side is increased (for example, two, three, and so on) to perform photographing dividedly, the accuracy increases further including a reason of a reduction in the influence of mist. Thus, it is preferable that the portion to be monitored be divided into many regions, and each divided region be photographed by a different camera. The number of cameras is equal to the number of divisions.

The following is a description of the processing of image thus obtained. Outlining with reference to FIGS. 3 and 4, the images photographed by the operation-side-camera 5*a* and the drive-side camera 5*b* are inputted to the image processing unit 6 (see signal 13A in FIG. 4), where the images are processed, and the change amount of separation point is quantified.

FIG. 6 shows examples of the images photographed by the operation-side camera 5*a* and the drive-side camera 5*b*. In FIG. 6(*a*), the separation line 3*a* on the operation side is given, and in FIG. 6(*b*), the separation line 3*b* on the drive side is given.

The image processing unit 6, which uses an image processing method such as a spatial filter, detects the boundary line between the center roll 2 and the wet paper 1 with an image plane coordinate system (a two-dimensional plane coordinate in which the upper left point of image is taken as (0, 0)) from the images photographed from two directions in such a way (see FIGS. 6(*a*) and 6(*b*)). The detected coordinate values are sent to the computer 8 according to the sampling cycle (see signal 13B in FIG. 4).

Specifically, the separation point of the wet paper 1 from the roll, which is shown as a boundary line of light and shade by using transillumination, can be extracted by a method such as a spatial filter for detecting an edge, which has generally been used in image processing. The coordinates on the image plane of the extracted separation lines 3*a* and 3*b* are sent to the computer 8.

The computer 8 converts the received plane coordinates into movement amount in each sampling cycle. In other words, the computer 8 determines the change amount and frequency of the separation point 3 of the paper edge and the whole shape of the separation line 3*a,* 3*b* from the received coordinate by computation. Specifically, if the installation position of camera is known, the roll edge face and the roll intermediate portion of the three-dimensional orthogonal coordinate system can be mapped to determine the corresponding position on a planar image in advance, and a position on the plane coordinates can thus be converted into a position on the three-dimensional orthogonal coordinate system. For example, conversion can be made into an orthogonal coordinate system in which the roll cross section is the XZ plane and the roll width direction is the Y axis.

The computation results are sent to the image processing unit 6 (see signal 13C in FIG. 4), and are outputted to the monitor TV 7 (see signal 13D in FIG. 4). The computer 8 outputs a control signal to the motor 10 (see signal 13E in FIG. 4).

The computer 8 carries out control to synchronize the operation-side camera 5*a,* the drive-side camera 5*b,* the image processing unit 6, and the scanner 12. Although basically, the camera system cannot accommodate a frequency higher than 60 Hz, the change frequency of separation point is typically lower than 60 Hz, so that there is actually no problem.

Figure 7:
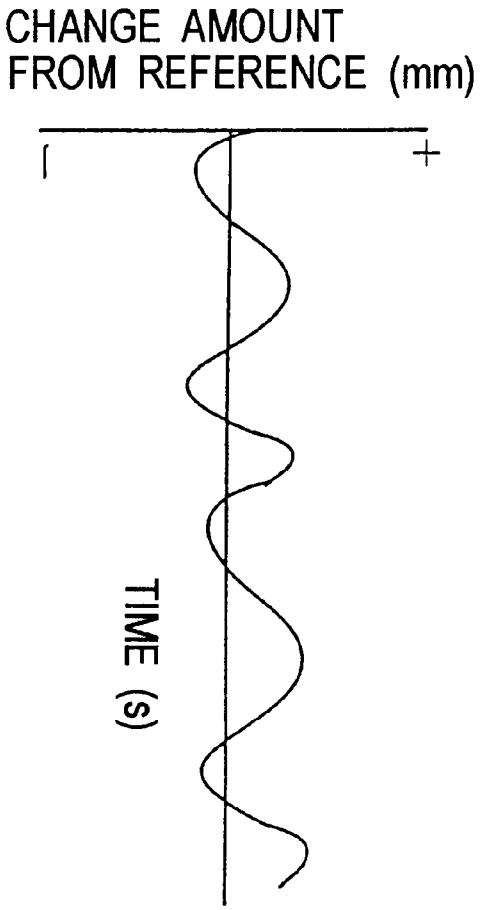
FIG. 7 is a graph obtained by the processing performed by an image processing unit and a computer, FIG. 7(*a*) showing a change in separation point, in which the ordinates represent the change amount from the reference and the abscissas the time(s), and FIG. 7(*b*) showing a separation line at a certain time, in which the ordinates represent the change amount from the reference and the abscissas the position in the width direction of a center roll 2.
Figure 7:
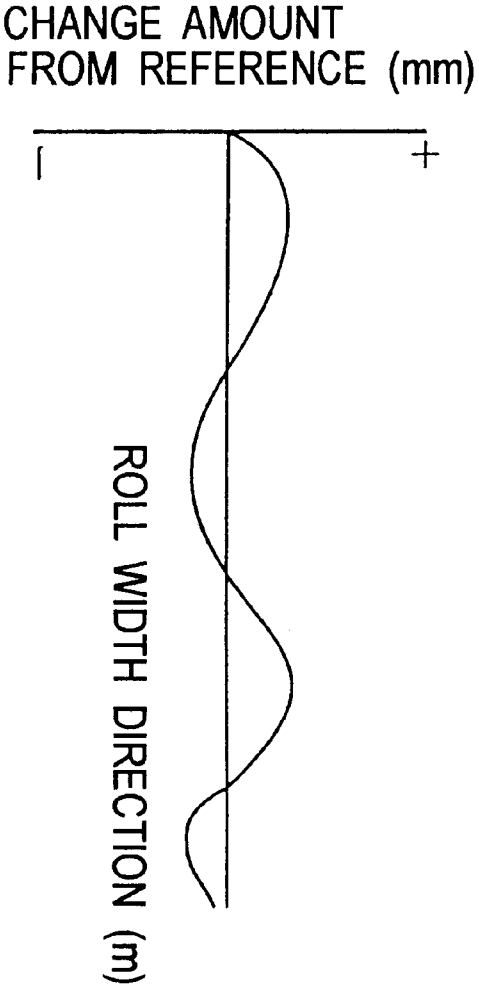

Next, graphs obtained by the above-described processing will be explained with reference to FIG. 7. FIG. 7(*a*) shows a change in separation point, in which the ordinates represent the change amount from the reference and the abscissas the time(s), and FIG. 7(*b*) shows a separation line at a certain time, in which the ordinates represent the change amount from the reference and the abscissas the position in the width direction of a center roll 2. With the apparatus of this embodiment, since a mechanism in which photographing is performed while scanning with the light 9*a* of the light source 9, the separation line representing a plurality of transversely different locations at the same time, as shown in FIG. 7(*b*) cannot strictly be obtained. However, since the scanning speed is high, the shift of time of one scan is neglected.

The separation point 3 at the paper edge, on the operation side, changes as shown in FIG. 7(*a*). The state of change can be understood by this graph. Therefore, the allowable values (trouble diagnosis conditions) of the change amount and frequency of the separation point 3 can be set in the computer 8. In setting these trouble diagnosis conditions, the conditions can be changed appropriately according to the basis weight and draw amount of paper. Although the computer 8 has a function of quantitatively monitoring the change amount of separation point and also of diagnosing a trouble or problem condition of the paper machine the diagnosis analysis, and the diagnosis apparatus, i.e., (diagnosis means), in this embodiment, the diagnosis analysis, and the diagnosis apparatus, i.e., diagnosis means, may be provided separately from the computer 8.

Also, if the movement amounts at positions in the paper width direction of wet paper 1 (the width direction of the center roll 2) are connected, the shape of separation line 3*a*, 3*b* can be determined. That is to say, unlike FIG. 7(*a*) showing one point, the change of separation a plurality of locations distributed; in the width direction of the roll can be found. If a data set representing separation in the width direction under acceptable operation conditions, e.g., data representing of the shape of the separation line at a normal time, has been determined in advance, the change amount can be determined. Therefore, the trouble diagnosis conditions can be set by comparing data representing the monitored change amount with respect to the shape of separation line 3*a*, 3*b* at the normal time. For example, when the change amount of at least one point of separation points exceeds a predetermined value, the machine can be judged to have a trouble. However, needless to say, the method is not limited to this. In this case as well, the conditions i.e., the standard data set and/or the permitted change amount or amounts can be changed appropriately according to the basis weight and draw amount of paper.

Thus, a machine trouble resulting in paper breakage can be predicted. Also, if such a trouble occurs, for example, an alarm can be given to tell the operator the occurrence of trouble. Therefore, the draw amount can be changed before paper breakage occurs. That is to say, by changing the draw amount, the press part can be controlled so as to correct the shape of profile. The change amount of separation point and the shape of separation line are important in predicting paper breakage, and paper breakage can be prevented before it happens. The configuration may be such that the draw amount can be controlled automatically by control means (not shown) connected to the computer 8.

In addition, by the shape of separation line and the magnitude of replacement amount of separation point, the change time of a tool such as the time for replacement of the felt, can be identified.

Immediately after the change of felt, if the draw is constant, the dehydration state is poor, and the separation point changes. By changing the draw, the separation point is controlled to a fixed separation position. In two or three days, the felt adjusts itself to the machine, so that the dehydration state is improved. Therefore, by changing the draw, the separation position is set at a predetermined position. If the machine is operated in this state, the dehydration state becomes poor after a certain period of time, and the separation point changes, so that the tool must be changed at an earlier time. Therefore, the dirt and surface condition of the changed felt are analyzed quantitatively and are used as a data base together with the draw amount and the change amount of separation point, by which a proper change time considering both of the paper quality and the economical condition of tool cost etc. can be identified.

What is claimed is:

1. A monitoring apparatus comprising:

a light emitting source configured to transmit light onto a continuous running paper sheet moving between rolls in a paper machine;

at least one camera configured to receive light from said source which has been transmitted through a portion of said paper sheet;

an image processor connected to the camera to receive image data corresponding to said light transmitted through said portion of said sheet; and a diagnosis apparatus configured to receive data from said processor and to diagnose a trouble condition of the paper machine by quantitatively monitoring the change amount of a separation point where paper in said portion of said sheet separates from a roll, based on the data received from said processor.

2. The monitoring apparatus according to claim 1 wherein said light emitting source comprises a metal halide lamp.

3. The monitoring apparatus according to claim 1 additionally comprising a controller connected to the diagnosing apparatus and configured to change said configuration to diagnose a trouble condition according to predetermined basis weight and draw amount values.

4. The monitoring apparatus according to claim 3 additionally comprising a draw control apparatus connected to a portion of said paper machine and configured to control a draw amount value in said paper machine in response to said diagnosing apparatus.

5. The monitoring apparatus according to claim 2 additionally comprising a control apparatus connected to said diagnosing apparatus and configured to change said configuration to diagnose according to predetermined basis weight and draw amount values.

6. The monitoring apparatus according to claim 5 further comprising a control apparatus connected to said paper machine and configured to control a draw amount value of said paper machine in response to said diagnosis apparatus.

7. The monitoring apparatus according to claim 1 wherein said at least one camera comprises a plurality of cameras, each of said plurality of said cameras being configured to receive light from a different region of said portion of said paper sheet.

8. The monitoring apparatus according to claim 1 wherein said at least one camera comprises a plurality of cameras, each of said plurality of said cameras being configured to receive light from a different region of said portion of said paper sheet.

9. A monitoring process comprising the steps:

transmitting light onto a continuous paper sheet moving between rolls in a paper machine;

receiving light which has been transmitted through a portion of said paper sheet and generating image data therefrom, and diagnosing a trouble condition of the paper machine by quantitatively monitoring a change amount of a separation point where paper separates from a roll based said image data.

10. The monitoring process according to claim 9 wherein said light transmitting step comprises transmitting light from a metal halide lamp.

11. The monitoring process according to claim 9 wherein said diagnosing step is varied according to predetermined basis weight and draw amount values.

12. The monitoring process according to claim 11 additionally comprising the step of controlling a draw amount value in said paper machine in response to said diagnosing step.

13. The monitoring process according to claim 10 wherein said diagnosing step is varied according to predetermined basis weight and draw amount values.

14. The monitoring process according to claim 13 further comprising the step of controlling a draw amount value of said paper machine in response to said diagnosing step.

15. The monitoring process according to claim 9 wherein said receiving step comprises receiving said light in a plurality of cameras, each of said plurality of said cameras being configured to receive light from a different region of said portion of said paper sheet.

* * * * *

UNITED STATES PATENT AND TRADEMARK OFFICE

CERTIFICATE OF CORRECTION

PATENT NO. : 6,388,749 B1
DATED : May 14, 2002
INVENTOR(S) : Yamashita et al.

It is certified that error appears in the above-identified patent and that said Letters Patent is hereby corrected as shown below:

Title page,
Item [73], "Assignee: Mitsubishi Heavy Industries, Ltd., Tokyo (JP)" should read -- Assignees: Mitsubishi Heavy Industries, Ltd., Tokyo (JP); Oji Paper Co., Ltd., Tokyo (JP) --.
Item [56], References Cited, FOREIGN PATENT DOCUMENTS, insert -- JP 3-130492 6/1991 --.

Column 7,
Line 9, after "as" insert -- is --;
Line 10, after "FIG. 7(*b*)" insert a comma (,);
Lines 23-24, after "machine" cancel "the diagnosis analysis, and the diagnosis apparatus, i.e.,";
Line 25, after "means)" cancel the comma (,);
Line 32, after "separation" insert -- of --.
Line 33, after "distributed" cancel the semicolon (;);
Line 36, "representing" should read -- representative --.
Line 46, after "amounts" insert a comma (,);
Line 63, "replacement" should read -- change --;
Line 64, "change" should read -- replacement --.

Column 9,
Line 3, after "based" insert -- on --.

Signed and Sealed this

Twenty-seventh Day of August, 2002

*Attest:*

*Attesting Officer*

JAMES E. ROGAN
*Director of the United States Patent and Trademark Office*